US009574347B2

(12) United States Patent
Thiercelin

(10) Patent No.: US 9,574,347 B2
(45) Date of Patent: Feb. 21, 2017

(54) METHOD FOR CONSTRUCTING A BUILDING HAVING STRONG THERMAL INSULATION AND BUILDING CONSTRUCTED BY MEANS OF SAID METHOD

(71) Applicant: POP-UP HOUSE, Marseilles (FR)

(72) Inventor: Corentin Thiercelin, Ensues (FR)

(73) Assignee: Popup-House, Marseilles (FR)

( * ) Notice: Subject to any disclaimer, the term of this patent is extended or adjusted under 35 U.S.C. 154(b) by 0 days.

(21) Appl. No.: 14/439,833

(22) PCT Filed: Oct. 28, 2013

(86) PCT No.: PCT/FR2013/052572

§ 371 (c)(1),
(2) Date: Apr. 30, 2015

(87) PCT Pub. No.: WO2014/076385

PCT Pub. Date: May 22, 2014

(65) Prior Publication Data

US 2015/0300018 A1 Oct. 22, 2015

(30) Foreign Application Priority Data

Nov. 14, 2012 (FR) ..... 12 60856

(51) Int. Cl.
*E04C 2/296* (2006.01)
*E04B 1/14* (2006.01)
(Continued)

(52) U.S. Cl.
CPC ..... *E04C 2/296* (2013.01); *E04B 1/14* (2013.01); *E04B 1/26* (2013.01); *E04B 1/76* (2013.01);
(Continued)

(58) Field of Classification Search
CPC ..... E04C 2/10; E04C 2/46; E04C 2/296; E04C 2/284; E04B 1/76; E04B 1/14; E04B 1/18; E04B 1/26; E04B 2103/04; E04B 2001/264
(Continued)

(56) References Cited

U.S. PATENT DOCUMENTS 3,254,464 A 6/1966 Hoyt, Jr.
3,363,378 A * 1/1968 Palfey ..... E04C 2/18 52/285.3
(Continued)

FOREIGN PATENT DOCUMENTS

CA 1116371 A1 1/1982
EP 0190818 A2 8/1986
(Continued)

*Primary Examiner* — Beth Stephan
(74) *Attorney, Agent, or Firm* — Bachman & LaPointe, P.C.

(57) ABSTRACT

A building comprising strong thermal insulation, at least some walls of which consist of panels made of a low-density thermally insulating material, wherein the panels have edge surfaces which are uniformly planar over an entire thickness thereof and are assembled to one another by interleaving boards in joint areas between two adjacent panels, the boards being connected in contact with the panels over an entire length and width of edge surfaces in said joint areas, so that a junction of the boards with the panels prevents by itself alone deformation of the boards in bending transversally to their plane and in twisting and that the panels ensure wind bracing of the walls.

14 Claims, 3 Drawing Sheets

(51) Int. Cl.
*E04B 1/26* (2006.01)
*E04B 1/76* (2006.01)
*E04B 2/00* (2006.01)

(52) U.S. Cl.
CPC ..... *E04C 2/46* (2013.01); *E04B 2001/264* (2013.01); *E04B 2103/04* (2013.01)

(58) Field of Classification Search
USPC ..... 52/309.1, 309.3, 309.7, 745.19
See application file for complete search history.

(56) References Cited

U.S. PATENT DOCUMENTS 3,755,982 A 9/1973 Schmidt
4,011,701 A * 3/1977 Turkia ..... E04C 2/386 52/275
4,288,962 A * 9/1981 Kavanaugh ..... E04B 2/562 52/220.1
4,443,988 A * 4/1984 Coutu, Sr. ..... E04B 1/80 52/309.2
4,641,468 A * 2/1987 Slater ..... E04B 1/12 52/309.4
4,852,310 A * 8/1989 Henley ..... E04B 1/74 52/404.3
4,937,122 A * 6/1990 Talbert ..... B32B 3/22 428/120
5,003,742 A * 4/1991 Dettbarn ..... E04B 2/707 52/282.3
5,134,817 A * 8/1992 Richardt ..... A01G 1/08 404/7
5,274,971 A * 1/1994 Elmore ..... E01F 8/0023 181/284
5,353,560 A * 10/1994 Heydon ..... B26D 3/006 52/241
6,044,603 A * 4/2000 Bader ..... E04C 2/384 52/309.16
8,516,778 B1 * 8/2013 Wilkens ..... E04C 3/292 52/309.13
2010/0058700 A1 * 3/2010 LeBlang ..... E04B 1/165 52/506.05
2011/0036046 A1 * 2/2011 Henriquez ..... E04B 1/161 52/764
2011/0173925 A1 * 7/2011 Brown ..... E04B 1/14 52/794.1
2011/0239573 A1 * 10/2011 Lockhart ..... E04B 2/7412 52/404.1
2012/0011793 A1 * 1/2012 Clark ..... E04C 3/122 52/309.4
2013/0019549 A1 * 1/2013 Henriquez ..... E04B 1/14 52/220.2

FOREIGN PATENT DOCUMENTS

EP 0294079 A1 12/1988
FR 2037268 A7 * 12/1970
GB 2440803 A 2/2008
JP 2007056468 A * 3/2007

* cited by examiner

METHOD FOR CONSTRUCTING A BUILDING HAVING STRONG THERMAL INSULATION AND BUILDING CONSTRUCTED BY MEANS OF SAID METHOD

BACKGROUND

The invention relates to a new method for constructing buildings having strong thermal insulation and building constructed by means of said method.

Methods for constructing buildings which notably aim at improving the thermal insulation are already known. Generally, the concepts developed essentially consist in using panels made of a material with a low thermal transfer coefficient, such as, for example, expanded polystyrene. In certain cases, these panels are used only to form the walls of construction for the structure of which is a framework which alone ensures the required mechanical strength, the only function of the insulating panels is to make walls and partitions and provide thermal insulation therefore without ensuring structural functions from the building mechanical strength point of view.

Other methods have also been developed, aiming at using a maximum of light insulating panels as structural elements. Thus, buildings constructed only by assembling polystyrene panels glued together have already been proposed. However, in this type of construction, it is commonly planned to coat the walls thus formed with a layer of reinforced mortar acting as mechanical reinforcement to take the vertical loads and also acting as facings resistant to shocks, adverse weather conditions, etc.

It has also been proposed to make panels or blocks of light insulating material integrating such facings and to assemble these by gluing or other methods. For example, it has already been proposed to make such panels with thick polystyrene cores and thin resin facings and to assemble them by a resin joint covering the edges of the panels and securing the facings of adjacent panels.

Document U.S. Pat. No. 3,755,982 notably describes a light material panel system with high insulating characteristics and where the edge surfaces comprise longitudinal grooves. These panels can notably be assembled by a large settable material joint, poured between the edges of two adjacent panels and penetrating therefore into the grooves thus ensuring a tight and resistant joint. Moreover, this settable material, once hardened, forms a post ensuring resistance against loads.

U.S. Pat. No. 3,254,464 shows hollow cells polyurethane insulating panels covered with a skin and connecting splines between the panels inserted into hollow half-cells formed on the edge surfaces of the panels. However, this system requires panels of complex shape and the use of wooden posts inserted into at least some of the cells to ensure the mechanical strength of the partitions thus formed.

EP0190818 shows a similar assembly system, but for insulating panels of simpler shape, solid and with flat faces. In this system, the panels are assembled with interleaving posts, the junctions between the panels and the posts also being made by longitudinal splines. CA1116371 also shows a similar system, but where the posts located at each junction between panels are replaced by simple splines, the reduced strength of these being compensated for by the insertion of stiffeners into the grooves formed in the faces of said panels. EP0294079 also describes a spline or groove and tongue assembly system.

The disadvantage of these various systems is notably that grooves or other forms required for socketing must be made on the edge surfaces of the panels.

The aim of the invention is to solve the problems described above and in particular aims at simplifying the construction of walls, ceilings and floors, and in ensuring the thermal insulation of buildings by exclusively using light construction elements.

SUMMARY

With these targets in mind, the object of the invention is a method for constructing a building having strong thermal insulation, at least some walls of which are essentially made of low-density thermally insulating material.

According to the invention, the method is characterised in that the panels are cut to the required dimensions, with continually planar edge surfaces over the complete thickness of the panels and the panels are assembled together by interleaving boards at the joint areas between two adjacent panels, the boards being connected in contact with the panels over the complete width of the edge surfaces in said joint areas.

The construction method thus allows the construction to be greatly simplified by using panels with planar edge surfaces, which can be obtained by a simple straight cut, and requiring no specific shaping of the edge surfaces such as the making of grooves or tongues, etc.

According to a first embodiment, the panels are assembled with the boards along the complete length and width of said joint areas by gluing and/or fitting.

According to another embodiment, the panels are assembled by being clamped between two boards located on opposite edge surfaces of the panels. The assembly can be done by screwing one board onto the other through the width of the panel clamped between said boards, or by strapping around both the boards and the panel clamped between said boards.

The object of the invention is also a building having strong thermal insulation at least some of the walls of which essentially consist of panels made of a low-density thermally insulating material, the building being characterised in that the panels have uniformly planar edge surfaces over their complete thicknesses and are assembled together with interleaving boards at the joint areas between two adjacent panels, the boards being connected in contact with the panels over the complete length and width of the edge surfaces at said joint areas.

Here, "wall" means both vertical walls comprising structural walls or other partitions, horizontal walls comprising slabs or ceilings and also inclined walls which can, for example, comprise building roofings. The joint areas are made between the edge surfaces of two panels assembled side by side in a given plane, or between the edge surface of a panel and a face of another panel in corner assembly case. Also, according to the geometries of the buildings, there can be bevel assemblies, on the edge surfaces or even on the ends of the faces to make all required angles.

The invention allows very good thermal insulation of buildings to be ensured by exclusively using light construction elements with high thicknesses, typically 150 to 500 mm or more, preferentially around 300 mm. The lightness of the elements and their high strength resulting from their thicknesses make them easy to use and transport and provide the construction with good mechanical and seismic properties. These advantages contribute towards reducing manufacturing times and costs.

As the width of the joint areas, and therefore the width of the boards, is at least equal to the thickness of the panels, or higher for bevel corner assemblies, the boards offer high bending strength in their in-plane direction. Moreover, in spite of the relatively low thickness of the boards, their junction with the panels also prevents their deformation in bending transversally to their plane or deformation in twisting and therefore eliminates all risk of buckling under vertical loads when the boards are vertical. When the panels are horizontal, for slabs, or inclined, for roofs, here again the panels ensure that the boards will remain flat, in a vertical plane, without possibility of twisting and therefore with best possible bending strength thanks to the relatively large width of the boards.

It is therefore the combination and the rigid assembly of the boards and panels which ensure the overall strength of the walls thus made up, whether they are positioned vertically, horizontally or inclined, whilst the boards themselves are maintained in a substantially vertical plane. Also note that, as a consequence, the boards can be used advantageously for the attachment of heavy elements to the walls or ceilings, for example electric water heaters or any other heavy conventional accessories.

Another advantage of the invention is safety in case of fire, in relation to insulating panel constructions according to prior art, in spite of the use of insulating materials such as expanded polystyrene. Indeed, in case of fire, the polystyrene will melt, but the boards will resist the fire longer and, by remaining assembled together, continue to ensure a certain resistance of the structure in spite of the disappearance of the insulating panels.

Also note that, notably thanks to the lightness of the materials used, a building formed by these partitions can be easily assembled in situ, but it is also possible to prefabricate complete walls in the workshop, then transport these prefabricated walls and assemble them on the worksite which allows the construction of a building in a very short time.

According to a first embodiment, the panels are assembled with the boards by gluing, the boards being glued flat onto the panels over the complete length and the width of said joint areas.

According to a second embodiment, the panels are assembled with the boards by fitting. In this case, in particular, strips are attached to the edge surfaces of the boards to form flanges of I or H sections, and the edge surfaces of the panels are inserted by force between said flanges of the sections thus formed. The result is a socketing of the edges of the panels in the sections, ensuring the rigid assembly of the panels with the boards. This assembly by fitting can be completed by gluing of the panels on the cores or between the flanges of the sections. In the case where the panels are not glued to the sections, maintaining the socketing of the panels in the sections can be guaranteed by connecting together the sections of a given assembly of coplanar panels, for example by battens as will be indicated later. An advantage of this second embodiment, without gluing is that it allows easy removal of the construction, and easy recycling of the materials in case of deconstruction.

In the first embodiment, the boards can also be connected together, for example by horizontal battens attached to the edge surfaces of the boards to supplement the stiffness of the structure and/or to act as support for a covering or various technical equipment of the building.

According to another embodiment, the panels are assembled by being clamped between two boards located on opposite edge surfaces of a panel. The assembly can be achieved by screwing one board onto the other through the width of the panel clamped between said boards, by long wood screws or by strapping around both the boards and the panel clamped between said boards.

Whatever the embodiment, boards placed against the free edge surfaces of the panels can also be used either at an end of a wall or in the corners where an edge surface is apparent on the side leaving the corner to reinforce these ends or these corners.

The panels are preferentially made of expanded foam of the following types: expanded polystyrene, extruded polystyrene, polyurethane foam, resol foam. Wooden fibres, dense rock wool, dense glass wool or cork panels can also be used. Generally, materials offering the best possible characteristics in terms of thermal insulation and low density will be used so that even large-size panels can be handled with a minimum of transport and lifting equipment and a minimum of manpower, in particular be handled and used by one or two persons.

The boards are preferentially made of milled wood, plywood, multi-ply wood, LVL, etc. with possibility of fire-retardant treatment.

They can also be made of a rigid material, with fire resistant properties, for example in the form of composite wood or metallic strips.

The boards have a width substantially equal to the thickness of the panels and a thickness lower than their width, in a ratio typically between ⅛ and 1/15. For example, the cross-section of these boards can be 30 cm×3 cm, that is a ratio of around 10 between width and thickness.

The low thickness of the boards also has the advantage of making them light so that they can be easily handled by one person. Thus, a building in compliance with the invention can be constructed with a minimum of handling equipment and very little manpower.

For the second embodiment, the strips can be made of the same material as the boards and of same thickness, or be made of a different material and of a thickness also different. The strips are attached to the edge surfaces of the boards by gluing, screwing, etc.

For the glued assembly, the adhesive for assembling the panels and the boards is chosen according to the materials of these panels and boards. For example, polyurethane, epoxy, neoprene adhesives, etc. can be used. The adhesives used must ensure a strong and reliable junction between the boards and the panels because, particularly for the first variant, it is this gluing which ensures the mechanical strength of the complete construction.

In spite of the low thickness of the boards, the glued and/or socketed assembly of boards and panels or, also, assembly by clamping panels between two boards, allows a very good mechanical strength to be obtained. Indeed, first of all, the panels ensure the wing bracing of the various walls and therefore prevent the deformation of the complete construction. By being joined to the boards by gluing, force socketing or by being clamped between two boards, the panels also prevent the deformation of the boards, especially in bending and twisting, and compensate in a way for the relative flexibility of the boards resulting from their low thickness, to conserve and improve their compression strength in the longitudinal direction. The panels therefore prevent the buckling of the boards even under high axial loads. They also prevent the twisting of the boards, hence also resulting in, thanks to the relatively high width of the boards, a high bending strength in the general plane of the boards. In the assembly of the boards and panels, this compensates for the relatively low bending strength of the insulating panels which have a thickness substantially equal to the width of the boards. This high bending strength thus obtained by the assembly of the boards and panels notably allows slabs or roofs to be made.

As the boards have a width equal to or higher than the thickness of the panels, battens or other sections can be attached to the edge surfaces of the boards, on the inner or outer side of the wall or, again, on the two sides, allowing protective or decorative coverings of all known types to be attached to. Battens or similar sections, attached to the edge surfaces of the boards can also be used to join boards placed at a distance together and thus consolidate the assembly of boards and panels. These battens can be positioned perpendicularly to the boards or also obliquely to provide wind bracing in addition to that which is obtained generally by the panels themselves.

For the second variant, as already stated, the boards are completed by strips attached to the edge surfaces of the boards to comprise I or H sections, the edge surfaces of the panels then being inserted between the flanges of said sections. The I or H shape of the sections increases the strength of the boards for a given wall thickness or compensates for the effect of a lower width of the boards, for example for a reduced thickness of the panels, locally or for the complete construction. As an addition, a gluing can be made on the core of the I or H and completed possibly by gluing of the flanges of the sections on the edge of the large faces of the panels. In a similar way, boards completed by a strip to form a T or an angle can also be used locally, as required.

A conventional covering, for example of reinforced rendering, composite type, etc., can be applied to the walls thus composed in compliance with the invention, that is applied directly to the panels or to the edge surfaces of the boards. Typically, such a covering can be applied to the outer faces of the walls, and a decorative covering, gypsum plasterboard, panelling, etc. will be attached to the horizontal battens joining the boards and attached to the edge surfaces of these as described previously. Other coverings can also be attached in a similar manner: wooden panels, fibre-reinforced plates, metallic cladding, rain screens, etc. When the invention is used to make a slab, a floor can be laid in a conventional manner on joists attached to the edge surfaces of the boards or even directly to the boards if their spacing allows such use of the boards directly as joists. In a similar manner, if the invention is used to make a ceiling, conventional ceiling suspension sections can be attached to the edge surfaces of the boards or, possibly, gypsum plasterboards attached directly to the lower edge surfaces of the boards.

BRIEF DESCRIPTION OF THE DRAWINGS

A building in compliance with the invention and its construction method will be better understood and other features and advantages of the invention will become apparent on reading the following description.

Make reference to the appended drawings where.

DETAILED DESCRIPTION

Figure 1:
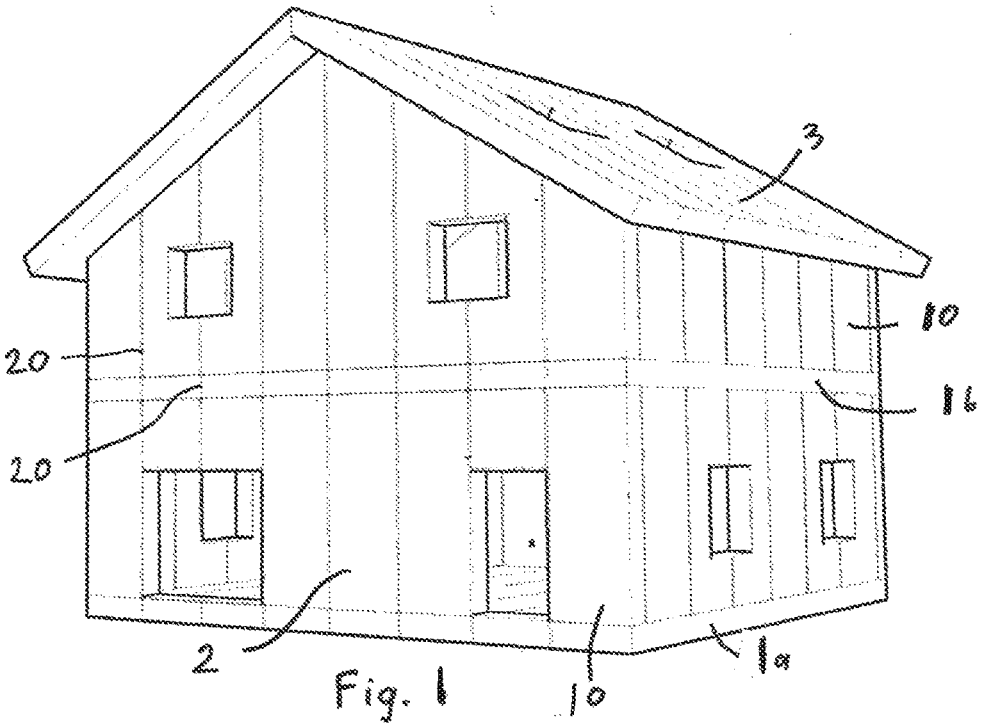
FIG. 1 is a perspective view of such a building.
Figure 2:
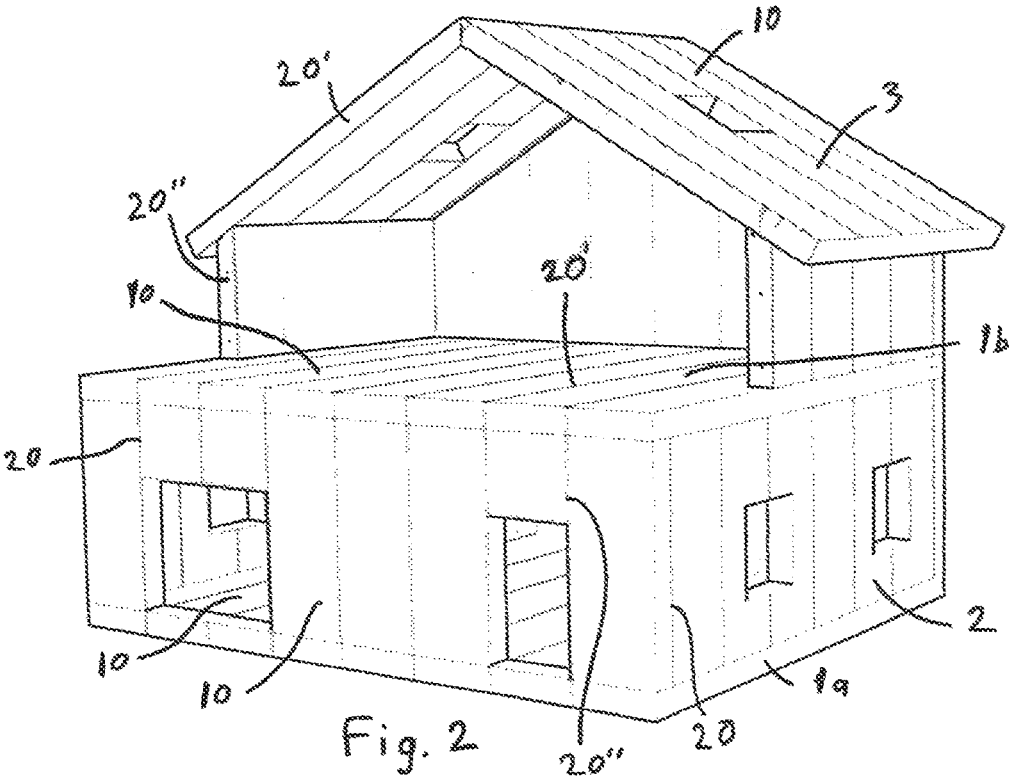
FIG. 2 is a similar view, with a part of the first floor removed to show the structure of the walls, floor and roof.

The building shown on FIGS. 1 and 2 is a house of a simple form, with one upper floor. The lower and upper slabs 1*a*, 1*b*, the walls 2 and the roof 3 are constructed in compliance with the invention by the assembly of polystyrene panels 10 with typical dimensions of 2.6 m×1.2 m×0.3 m thick and 3 cm thick plywood boards 20.

FIG. 2 notably shows the construction of the upper slab 1*b* and of the roof in compliance with the invention, the boards 20' of the slab and the roof resting respectively on the ends of the boards 20" of the walls.

The walls can be preassembled on the ground before being erected and joined to the walls already installed, by gluing, or screwing for example, at the corners.

Figure 3:
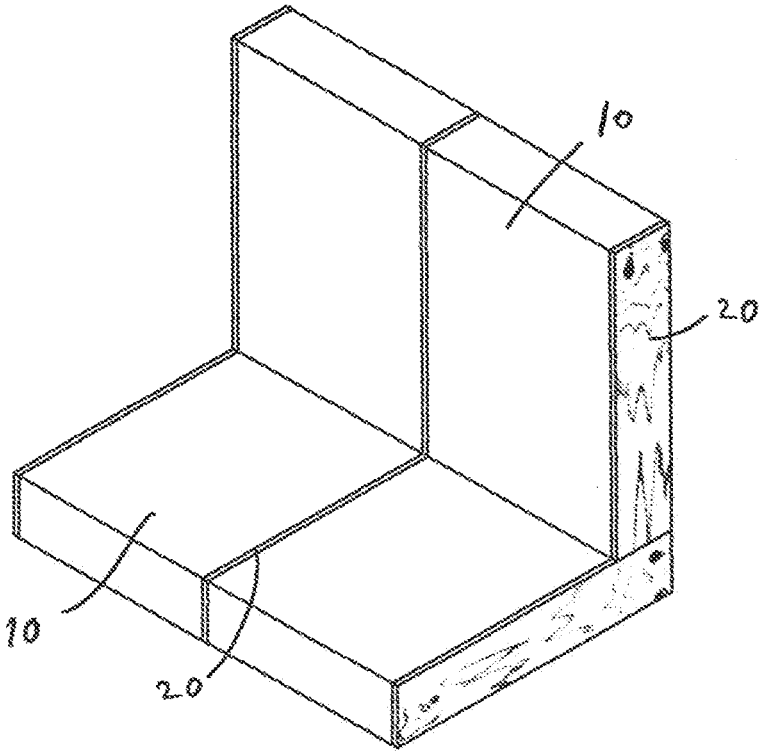
FIG. 3 is a perspective view showing an example of the assembly of panels and boards according to the first embodiment.

FIG. 3 shows the assembly of panels and boards according to the first embodiment, where the edge surfaces of the panels 10 are glued to the boards 20. At the corners, the boards of the vertical partition rest on the sides of the boards comprising the slab and can be attached by all conventional attachment means. The panels comprising the walls are also glued to those comprising the slab.

Figure 4:
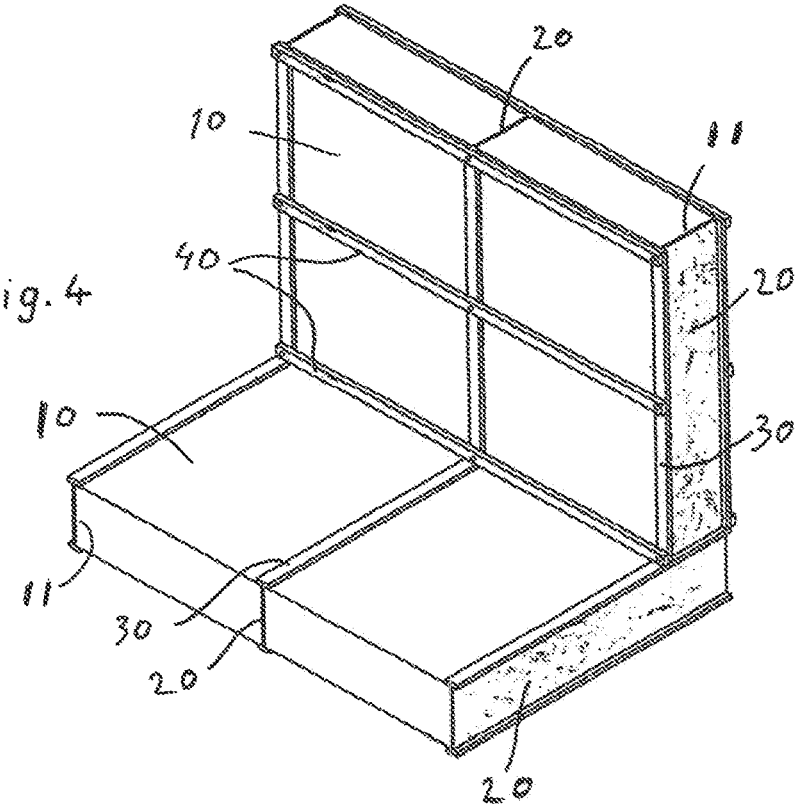
FIG. 4 is a perspective view showing an example of the assembly of panels and boards according to the second embodiment.

FIG. 4 shows the assembly of panels and boards according to the second embodiment, where strips 30 are attached to the edge surfaces of the boards 20 to comprise the I sections and the edge surfaces 11 of the panels are inserted by force between the flanges of said sections. FIG. 4 also shows the use of horizontal battens 40 attached by screws to the strips 30 and the edge surfaces of the boards 20. These battens 40 join several boards 20 together, as explained previously, and also allow an interior covering such as, for example, plasterboards to be attached. Electrical conduits can be placed between the panels 10 and these boards or any other finishing covering and held by the battens 40.

Figure 5:
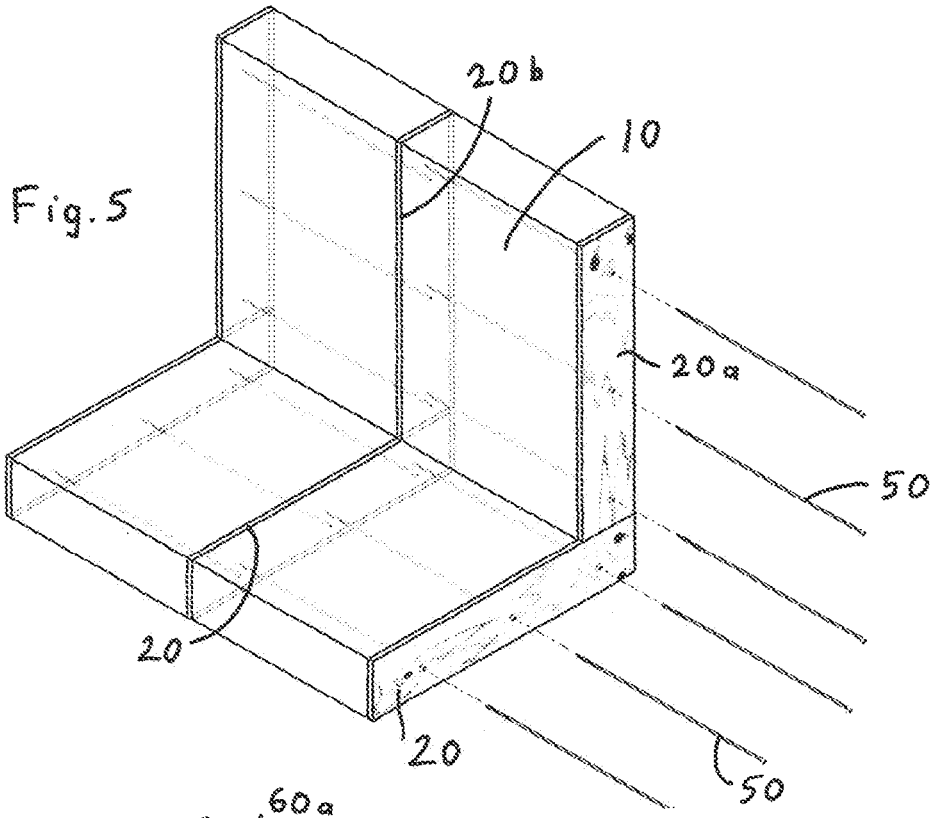
FIG. 5 is a perspective view showing an example of the assembly of panels and boards according to a third embodiment.

FIG. 5 shows the assembly of the panels and the boards according to a third embodiment, where the boards 20 are assembled by screwing, in order to clamp a panel 10 between two boards. For this purpose, special long wood screws 50 with a diameter of around 6 mm, for example, are used, the length of which is adapted to pass through, from a board 20*a* installed last, the complete width of the panel 10, and are screwed into the board 20*b* installed previously, located on the other side of the panel 10. This assembly method benefits from the ease by which screws 50 can pass through the light insulating panels. Also, the tightening of the screws ensures very good contact, under pressure, of the boards with the edge surfaces of the panels. This improves the strength of the assembly, favoured by the presence of screws forming a sort of reinforcement in the thickness of the wall and by the friction, resulting from the tightening of the screws, between the boards 20 and the edge surfaces of the panels 10.

The installation of a wall according to this embodiment is done simply by beginning by assembling a first panel between two boards screwed one to the other. Then, a second panel the edge surface of which is placed against one of the boards is added and a third board is installed that is screwed onto the board already in place through the second panel and so on. For the removal and the recycling of this construction, it suffices to unscrew the screws 50, to separate the boards and the panels, by starting by removing the last board installed during the installation.

Figure 6:
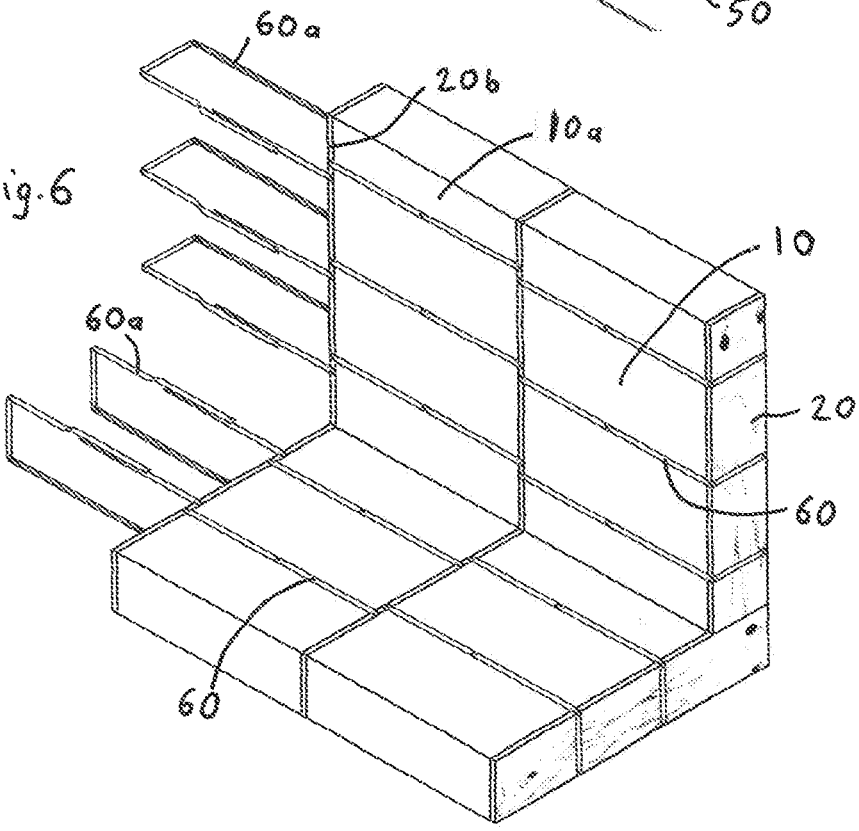
FIG. 6 is a perspective view showing an example of the assembly of panels and boards according to a fourth embodiment.

FIG. 6 shows the assembly of panels and boards according to a fourth embodiment, where the boards 20 are assembled by strapping by means of steel strips 60 for example. For the installation, as can be seen on FIG. 6, it suffices to place the strips 60*a* to be used to assemble a panel and a new board on a board 20*b* already in place, between said panel 20*b* and panel 10*a* before definitively strapping said board 20*b* to the panel 10*a* and so on.

For the embodiment cases of FIGS. 3, 5 and 6, battens, notably horizontal battens, can also be attached directly to the edge surfaces of the boards 20 to act as support for a covering, as explained previously, allowing ducts, conduits or cables to be passed between said covering and the surface of the panels.

The invention claimed is:

1. A building comprising strong thermal insulation, said building comprising at least one wall comprising panels made of a low-density thermally insulating material, wherein the panels have edge surfaces which are uniformly planar over an entire thickness thereof and are assembled to one another by interleaving boards such that each pair of adjacent panels has a joint area between the two assembled panels, the boards being connected in contact with the panels over an entire length and width of the edge surfaces in said joint areas, so that a junction of the boards with the panels prevents by itself alone deformation of the boards in bending transversally and in twisting and that the panels ensure wind bracing of the walls; wherein the panels are assembled by clamping, the panels having the edge surfaces opposite one another and one of said boards on each of the edge surfaces thereof being clamped between the boards located on the opposite edge surfaces of the panels; wherein the assembly includes boards on opposite edge surfaces of the panel, wherein a fastener extends through said boards and the panel.

2. The building according to claim 1, wherein the panels are assembled with the boards by adhesive.

3. The building according to claim 2, wherein strips are attached to edge surfaces of the boards to comprise I or H section flanges and the edge surfaces of the panels are inserted between the flanges of said sections.

4. The building according to claim 1, wherein the boards are joined by battens.

5. The building according to claim 4, wherein the battens act as support for an interior or exterior covering.

6. The building according to claim 1, wherein the panels are made of a material chosen from among: expanded foams, expanded polystyrene, extruded polystyrene, polyurethane foam, resol foam, wood fibre, rock wool, glass wool, cork, with at thickness from 150 to 500 mm.

7. The building according to claim 1, wherein the boards are made of at least one of milled wood, plywood or multi-ply wood, LVL, composite wood.

8. The building according to claim 1, wherein the boards have a width substantially equal to a thickness of the panels and a thickness in a relation included between ⅛ and 1/15 of the width.

9. The building according to claim 2, wherein the adhesive is selected from the group consisting of polyurethane, epoxy, and neoprene adhesives.

10. A construction method for a building having strong thermal insulation comprising: providing at least one wall, said at least one wall comprising panels made of a low-density thermally insulating material, cutting the panels to the dimensions required with continually planar edge surfaces over the entire thickness of the panels, and assembling the panels together with interleaved boards at junction areas between the two assembled panels, connecting the panels in contact over the entire length of the edge surfaces of the panels at joint areas in such a way that a junction of the boards with the panels prevents the deformation of the boards in bending transversally and in twisting and that the panels ensure the wind bracing of the walls.

11. The method according to claim 10, wherein the panels are assembled with boards over the entire length and width of said joint areas by gluing.

12. The method according to claim 10, wherein the panels are assembled by being clamped between the two boards located on opposite edge surfaces of the panels, by screwing of one board onto the other through a width of the panel clamped between said boards, or by strapping around both the boards and the panel clamped between said boards.

13. A building comprising strong thermal insulation, said building comprising at least one wall comprising panels made of a low-density thermally insulating material, wherein the panels have edge surfaces which are uniformly planar over an entire thickness thereof and are assembled to one another by interleaving boards in joint areas between the two assembled panels, wherein a fastener extends through and connects said boards and the panels on opposite edge surfaces of the panels; the boards being connected in contact with the panels over an entire length and width of the edge surfaces in said joint areas, so that a junction of the boards with the panels prevents, by itself alone, deformation of the boards in bending transversally and in twisting and that the panels ensure wind bracing of the walls.

14. A building comprising strong thermal insulation, said building comprising at least one wall comprising panels made of a low-density thermally insulating material, wherein the panels have edge surfaces which are uniformly planar over an entire thickness thereof and are assembled to one another by interleaving boards, such that each pair of adjacent panels has a joint area between the two assembled panels, the boards being connected in contact with the panels over an entire length and width of the edge surfaces in said joint areas, so that a junction of the boards with the panels prevents by itself alone deformation of the boards in bending transversally and in twisting and that the panels ensure wind bracing of the walls; wherein the panels are assembled with the boards by adhesive; wherein strips are attached to edge surfaces of the boards to comprise I or H section flanges and the edge surfaces of the panels are inserted between the flanges of said sections.

* * * * *